US011308908B2

(12) United States Patent
Wang et al.

(10) Patent No.: US 11,308,908 B2
(45) Date of Patent: Apr. 19, 2022

(54) LIQUID CRYSTAL DISPLAY PANEL AND DRIVING METHOD THEREOF

(71) Applicant: SHENZHEN CHINA STAR OPTOELECTRONICS SEMICONDUCTOR DISPLAY TECHNOLOGY CO., LTD., Shenzhen (CN)

(72) Inventors: Shan Wang, Shenzhen (CN); Yichien Wen, Shenzhen (CN)

( * ) Notice: Subject to any disclaimer, the term of this patent is extended or adjusted under 35 U.S.C. 154(b) by 266 days.

(21) Appl. No.: 16/618,368

(22) PCT Filed: Sep. 17, 2019

(86) PCT No.: PCT/CN2019/106222
§ 371 (c)(1),
(2) Date: Dec. 1, 2019

(87) PCT Pub. No.: WO2021/007946
PCT Pub. Date: Jan. 21, 2021

(65) Prior Publication Data

US 2021/0407449 A1 Dec. 30, 2021

(30) Foreign Application Priority Data

Jul. 18, 2019 (CN) ..... 201910648934.9

(51) Int. Cl.
*G09G 5/00* (2006.01)
*G09G 3/36* (2006.01)

(52) U.S. Cl.
CPC ..... *G09G 3/3674* (2013.01); *G09G 3/3685* (2013.01)

(58) Field of Classification Search
CPC ..... G09G 3/36; G09G 3/3674; G09G 3/3685; G02F 1/136286
See application file for complete search history.

(56) References Cited

U.S. PATENT DOCUMENTS 6,407,729 B1 6/2002 Moon
10,354,591 B2 * 7/2019 Zhou ..... G09G 3/3233
2006/0087486 A1 * 4/2006 Lee ..... G09G 3/342 345/102

(Continued)

FOREIGN PATENT DOCUMENTS

CN 104360555 A 2/2015
CN 105634445 A 6/2016

(Continued)

*Primary Examiner* — Joe H Cheng

(57) ABSTRACT

A liquid crystal display panel and a driving method thereof. The liquid crystal display panel comprises: a pixel unit module comprising a plurality of pixel units arranged in a matrix; a plurality of scanning lines, each of the scanning lines connected to at least two of the pixel units on a same row; a gate driving circuit connected to the plurality of scanning lines and providing gate signals for the scanning lines to control the pixel units, which the scanning lines are connected to, to be turned on; a plurality of data lines respectively connected to at least one pixel unit on different columns; a data driving circuit, which is connected to the plurality of data lines and provides data signals for the data lines to charge the turn-on pixel units which the data lines are connected to.

17 Claims, 4 Drawing Sheets

(56) References Cited

U.S. PATENT DOCUMENTS

| | | | | |
|---|---|---|---|---|
| 2007/0052646 | A1* | 3/2007 | Ishiguchi | G09G 3/3696 345/92 |
| 2007/0195035 | A1* | 8/2007 | Song | G02F 1/13452 345/87 |
| 2008/0049156 | A1* | 2/2008 | Kim | G09G 3/3648 349/40 |
| 2008/0062109 | A1* | 3/2008 | Kim | G09G 3/3611 345/92 |
| 2015/0310823 | A1* | 10/2015 | Wang | G09G 5/006 345/212 |
| 2016/0284297 | A1 | 9/2016 | Cheng et al. | |
| 2017/0061872 | A1* | 3/2017 | Zhou | G09G 3/3266 |
| 2017/0243529 | A1 | 8/2017 | Hung et al. | |
| 2019/0197978 | A1* | 6/2019 | Wu | G09G 3/3677 |
| 2019/0310529 | A1 | 10/2019 | Umezaki | |

FOREIGN PATENT DOCUMENTS

| | | | |
|---|---|---|---|
| CN | 105759524 | A | 7/2016 |
| CN | 105788504 | A | 7/2016 |
| CN | 106205511 | B | 10/2018 |
| CN | 109949772 | A | 6/2019 |
| CN | 109994085 | A | 7/2019 |
| JP | 2013041660 | A | 2/2013 |
| TW | 444184 | B | 7/2001 |

* cited by examiner

LIQUID CRYSTAL DISPLAY PANEL AND DRIVING METHOD THEREOF

CROSS REFERENCE TO RELATED APPLICATIONS

This application is the National Stage of PCT/CN2019/106222 field on Sep. 17, 2019, which claims priority of Chinese Application No. 201910648934.9 field on Jul. 18, 2019, the disclosure of which is incorporated by reference in its entirety.

FIELD OF INVENTION

The present disclosure relates to the field of display technologies, and more particularly to a liquid crystal display panel and a driving method thereof.

BACKGROUND OF INVENTION

With development of the display industry, requirements for all properties of display panels are increasing. Resolution requirements for the panels are also increasing, and refresh rate of the panel is increased, so that charging time of the panel is shortened. Along with influences of the panel manufacturing processes, the panel has a large RC load, which causes a time to turn on the gate to be inconsistent, further shortening the charging time. If the charging time of panels is too short, it will cause insufficient charging, thereby causing the display effect and uniformity of panels to decrease.

SUMMARY OF INVENTION

An object of the present disclosure is to provide a liquid crystal display panel and a driving method thereof, thereby improving uniformity and display effect of the liquid crystal display panel.

To solve the above technical problem, an embodiment of the present disclosure is to provide a liquid crystal display panel. The liquid crystal display panel comprises: a pixel unit module comprising a plurality of pixel units, the plurality pixel units arranged in a matrix; a plurality of scanning lines, each of the scanning lines connected to at least two of the pixel units on a same row; a gate driving circuit connected to the plurality of scanning lines and providing gate signals for the scanning lines to control the pixel units, which the scanning lines are connected to, to be turned on; a plurality of data lines, the plurality of data lines are respectively connected to the plurality of pixel units on different columns; a data driving circuit, which is connected to the plurality of data lines and provides data signals for the data lines to charge the turn-on pixel units which the data lines are connected to; wherein the data signals provided by the data driving circuit for the plurality of data lines are sequentially delayed that enables a time to be turned on matching a time to be charged for the plurality of pixel units in the liquid crystal display panel.

To solve the above technical problems, an embodiment of the present disclosure further provides a liquid crystal display device. The liquid crystal display device comprises the above liquid crystal display panel.

The difference from current techniques is that: the present disclosure provides a liquid crystal display panel, wherein the data signals provided by the data driving circuit for the plurality of data lines are sequentially delayed along a direction away from the gate driving circuit that enables a time to be turned on matching a time to be charged for the plurality of pixel units in the liquid crystal display panel, and makes the data signals have sufficient charging time, thereby solving nonuniform brightness of panels caused by insufficient charging of the data signals by the delayed gate signals and improving display quality of panels.

DESCRIPTION OF DRAWINGS

The accompanying figures to be used in the description of embodiments of the present disclosure or prior art will be described in brief to more clearly illustrate the technical solutions of the embodiments or the prior art. The accompanying figures described below are only part of the embodiments of the present disclosure, from which figures those skilled in the art can derive further figures without making any inventive efforts.

DETAILED DESCRIPTION OF PREFERRED EMBODIMENTS

The embodiments of the present disclosure are described in detail hereinafter. Examples of the described embodiments are given in the accompanying drawings. The specific embodiments described with reference to the attached drawings are all exemplary and are intended to illustrate and interpret the present disclosure. Based on the embodiments in the present disclosure, all other embodiments obtained by those skilled in the art without creative efforts are within the scope of the present disclosure.

Figure 1:
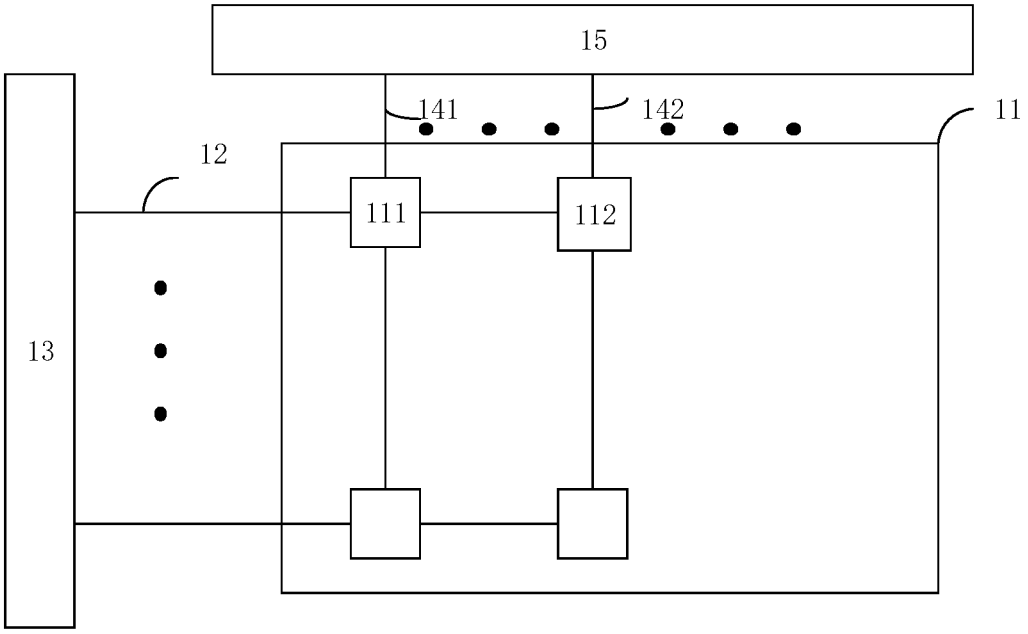
FIG. 1 is a schematic structural diagram of a liquid crystal display panel according to the first embodiment of the present disclosure.

Referring to FIG. 1, FIG. 1 is a schematic structural diagram of a liquid crystal display panel according to the first embodiment of the present disclosure. The liquid crystal display panel 10 comprises a pixel unit module 11 which comprises a plurality of pixel units, such as a pixel unit 111 and a pixel unit 112; scanning lines 12, a gate driving circuit 13, a data line 141, a data line 142, and a data driving circuit 15. Wherein the plurality of pixel units in the pixel unit module 11 are arranged in a matrix. Each of the scanning lines 12 is connected to at least two of the pixel units (such as the pixel unit 111 and the pixel unit 112) on a same row. The gate driving circuit 13 is connected to the scanning lines 12 and providing gate signals for the scanning lines 12 to control the pixel units (such as the pixel unit 111 and the pixel unit 112), which the scanning lines 12 are connected to, to be turned on. The data line 141 and the data line 142 are respectively connected to the pixel units on different columns (for example, the data line 141 is connected to the pixel unit 111, and the data line 142 is connected to the pixel unit 112). The data driving circuit 15 is connected to the data line 141 and the data line 142, and provides data signals for the data line 141 and the data line 142 to charge the turn-on pixel units (such as the pixel unit 111 and the pixel unit 112) which the data line 141 and the data line 142 are connected to.

When an area of the liquid crystal display panel 10 is large, due to RC delay, a received gate signal for the pixel unit 111 which is closer to the gate driving circuit 13 is very close to the original signal, and a received gate signal for the pixel unit 112 which is farther from the gate driving circuit 13 is a signal that gradually rises from a low to a standard value. The pixel unit 111 is faster than the pixel unit 112 to reach a turn-on state. The pixel unit 111 and the pixel unit 112 are on different columns, so the data signals are provided from different data lines (the data line 141 and the data line 142). The data signals provided by the data driving circuit 15 for the data line 141 and the data line 142 are sequentially delayed along a direction away from the gate driving circuit 13. That is data signals provided for the data line 142 are delayed than data signals provided for the data line 141, and data signals received by the pixel unit 112 are delayed than data signals received by the pixel unit 111. A time to be turned on for the pixel unit 112 is delayed than the pixel unit 111 that enables a time to be turned on matching a time to be charged for the pixel unit 112. Therefore, the charging time is sufficient for the data signals, and it effectively solves nonuniform brightness of panels, improving display quality of panels.

It should be noted that, only one scanning line, two pixel units, and two data lines are listed in the embodiment, and a plurality of scanning lines, pixel units, and data lines can be disposed in other embodiments.

From the above description, in the embodiment, the data signals provided by the data driving circuit for the plurality of data lines are sequentially delayed along a direction away from the gate driving circuit that enables a time to be turned on matching a time to be charged for the plurality of pixel units in the liquid crystal display panel, and makes the data signals have sufficient charging time, thereby solving nonuniform brightness of panels caused by insufficient charging of the data signals by the delayed gate signals and improving display quality of panels.

Figure 2:
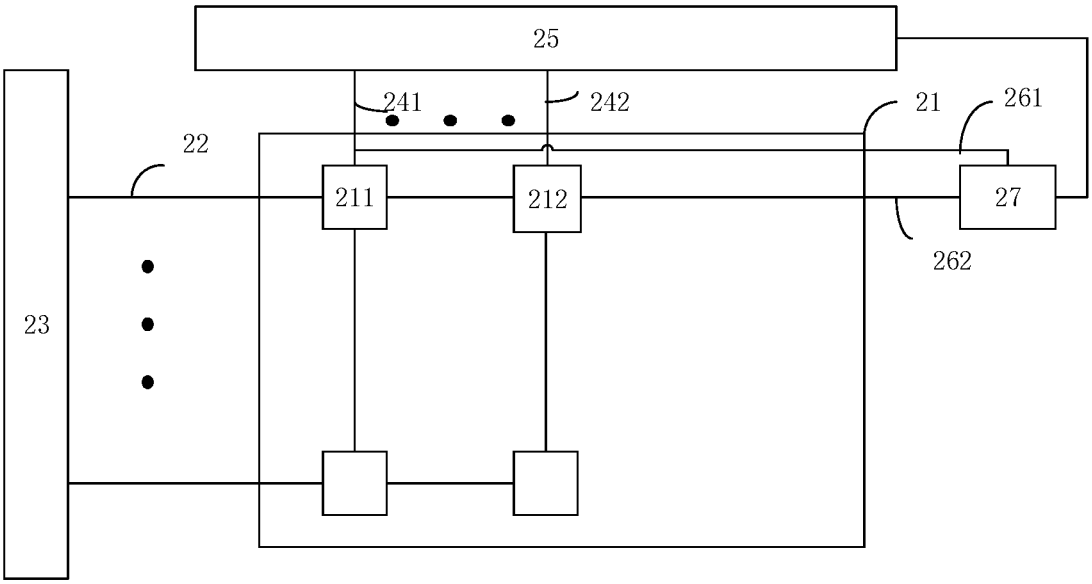
FIG. 2 is a schematic structural diagram of a liquid crystal display panel according to the second embodiment of the present disclosure.

Referring to FIG. 2, FIG. 2 is a schematic structural diagram of a liquid crystal display panel according to the second embodiment of the present disclosure. The liquid crystal display panel 20 comprises a pixel unit module 21 which comprises a plurality of pixel units, such as a pixel unit 211 and a pixel unit 212; scanning lines 22, a gate driving circuit 23, a data line 241, a data line 242, a data driving circuit 25, a monitor line 261, a monitor line 262, and a logic board 27.

Wherein the plurality of pixel units in the pixel unit module 21 are arranged in a matrix. Each of the scanning lines 22 is connected to at least two of the pixel units (such as the pixel unit 211 and the pixel unit 212) on a same row. The gate driving circuit 23 is connected to the scanning lines 22 and providing gate signals for the scanning lines 22 to control the pixel units (such as the pixel unit 211 and the pixel unit 212), which the scanning lines 22 are connected to, to be turned on. The data line 241 and the data line 242 are respectively connected to the pixel units on different columns (for example, the data line 241 is connected to the pixel unit 211, and the data line 242 is connected to the pixel unit 212). The data driving circuit 25 is connected to the data line 241 and the data line 242, and provides data signals for the data line 241 and the data line 242 to charge the turn-on pixel units (such as the pixel unit 211 and the pixel unit 212) which the data line 241 and the data line 242 are connected to.

The monitor line 261 is connected to the pixel unit 211, the monitor line 262 is connected to the pixel unit 212, and the pixel unit 211 and the pixel unit 212 are on a same row. The monitor line 261 and the monitor line 262 are used to respectively monitor a time to be turned on for the pixel unit 211 and the pixel unit 212. In the embodiment, a time to turn on the pixel units is a time for a gate signal voltage of the pixel units reaching 90% of a standard value. The standard value is a starting pulse voltage (STV) value provided by the gate driving circuit 23. For example, the pixel unit 211 is closest to the gate driving circuit 23, so a gate signal received by the pixel unit 211 reaches the STV value immediately, that is the pixel unit 211 is on a turn-on state immediately. If the time is recorded as 0, then a gate signal received by the pixel unit 212 which is farther from the gate driving circuit 23 is gradually rises from a low value, and after a time t, the gate signal voltage received by the pixel unit 212 reaches 90% of the STV value. That is the pixel unit 212 is turned on at time t. In other embodiments, other voltage values (such as 80% of the STV or 70% of the STV) can be set as a basis for judging if the pixel units are turned on.

The logic board 27 is connected to the monitor line 261 and the monitor line 262 to obtain the times of the pixel unit 211 and the pixel unit 212 to be turned on monitored by the monitor line 261 and the monitor line 262, and calculates a time difference between the times of the pixel unit 211 and the pixel unit 212 to be turned on according to the obtained times of the pixel unit 211 and the pixel unit 212 to be turned on. For example, the time difference is t in the embodiment. The logic board 27 is connected to the data driving circuit 25, and sends the calculated time difference t to the data driving circuit 25, thereby the data driving circuit can control the delay time between the data signals provided by the data line 241 and the data line 242 in accordance of the time difference t. That is the data signal provided by the data line 242 is delayed a time t than the data signal provided by the data line 241.

It should be noted that, only one scanning line, two pixel units, two data lines, two monitor lines, and a logic board are listed in the embodiment, and a plurality of scanning lines, pixel units, data lines, monitor lines, and logic boards can be disposed in other embodiments.

From the above description, in the embodiment, the time difference of the pixel units to be turned on can be accurately calculated through the monitor lines and the logic board, thereby the time difference of the data signals which are provided by the data driving circuit for the plurality of data lines and are delayed along a direction away from the gate driving circuit can be accurately obtained. It enables a time to be turned on matching a time to be charged for the plurality of pixel units in the liquid crystal display panel, and makes the data signals have sufficient charging time, thereby solving nonuniform brightness of panels caused by insufficient charging of the data signals by the delayed gate signals and improving display quality of panels.

Figure 3:
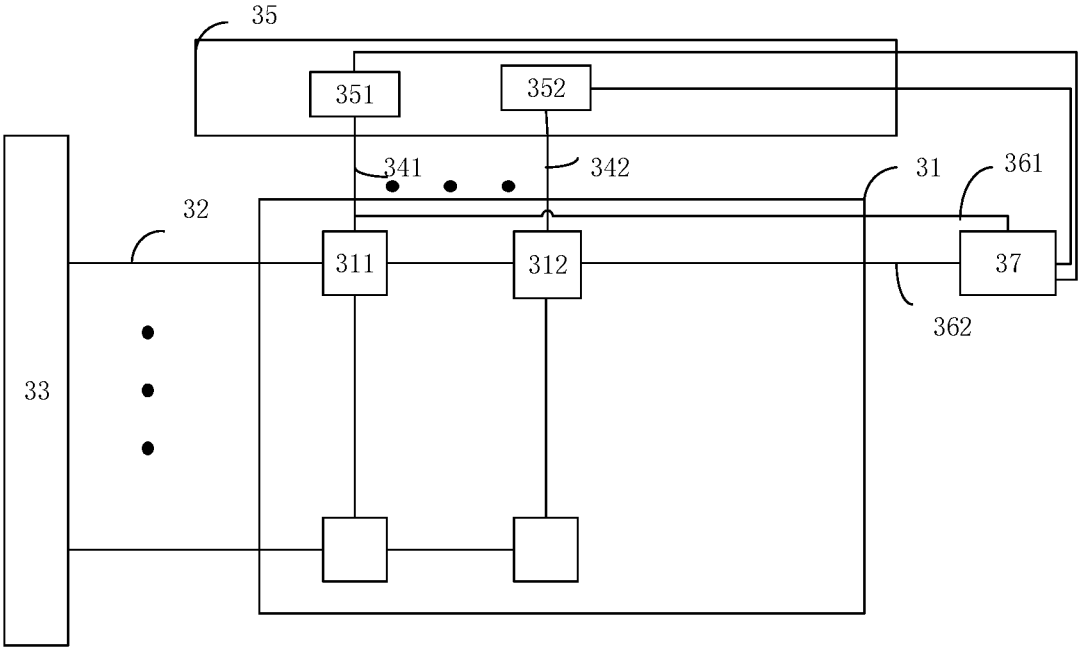
FIG. 3 is a schematic structural diagram of a liquid crystal display panel according to the third embodiment of the present disclosure.

Referring to FIG. 3, FIG. 3 is a schematic structural diagram of a liquid crystal display panel according to the third embodiment of the present disclosure. The liquid crystal display panel 30 comprises a pixel unit module 31 which comprises a plurality of pixel units, such as a pixel unit 311 and a pixel unit 312; scanning lines 32, a gate driving circuit 33, a data line 341, a data line 342, a data driving circuit 35, a monitor line 361, a monitor line 362, and a logic board 37. The structures and connection relationship of the pixel unit module 31, the pixel unit 311, the pixel unit 312, the scanning lines 32, the gate driving circuit 33, the data line 341, the data line 342, the data driving circuit 35, the monitor line 361, the monitor line 362, and the logic board 37 are consistent with those of the pixel unit module 21, the pixel unit 211, the pixel unit 212, the scanning lines 22, the gate driving circuit 23, the data line 241, the data line 242, the data driving circuit 25, the monitor line 261, the monitor line 262, and the logic board 27 in the liquid crystal display panel according to the second embodiment of the present disclosure, and which will not be iterated herein for the sake of conciseness.

The data driving circuit 35 comprises a data drive chip 351 and a data drive chip 352, the data drive chip 351 is connected to the data line 341, and the data drive chip 352 is connected to the data line 342. The data drive chip 351 and the data drive chip 352 are further connected to the logic board 37. The data signals provided by the data drive chip 351 for the data line 341 are delayed than the data signals provided by the data drive chip 352 for the data line 342. The data drive chip 351 and the data drive chip 352 in the embodiment are chips of chip on film (COF).

Figure 4:
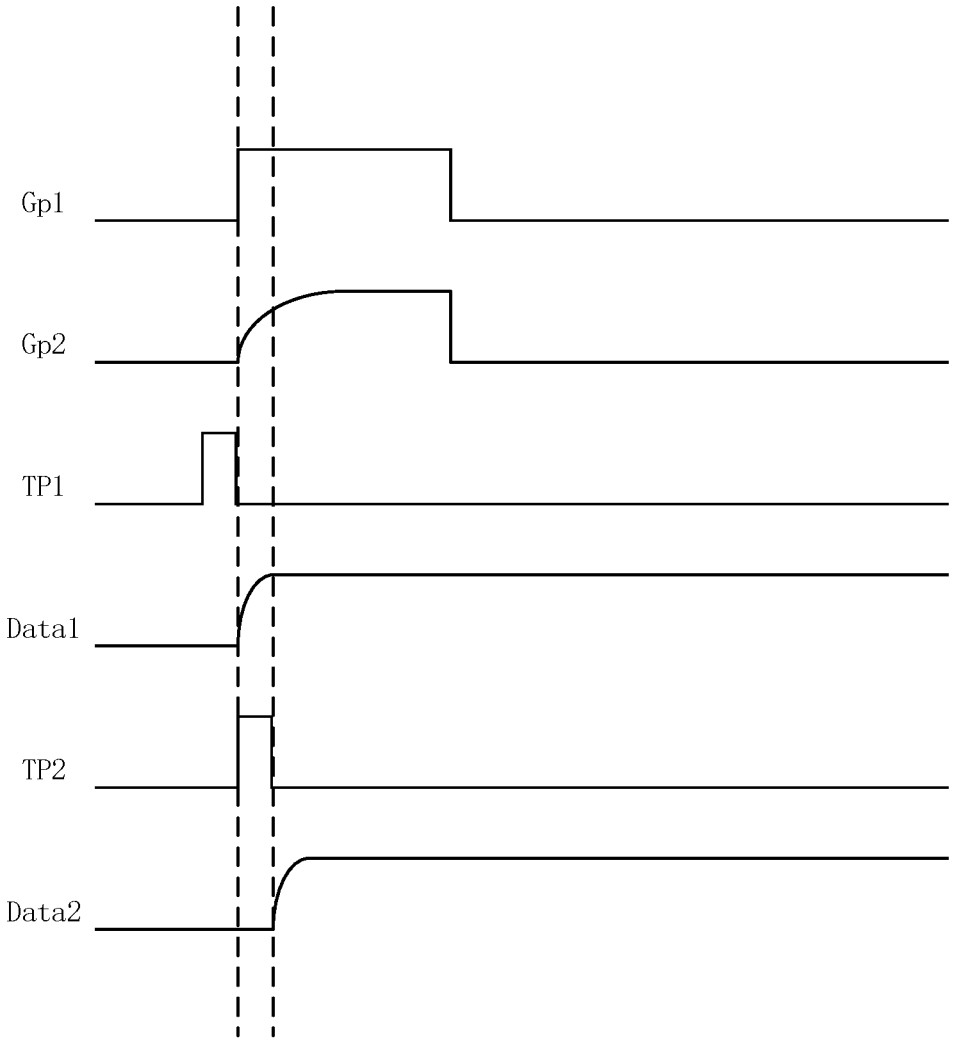
FIG. 4 is a schematic signal timing diagram of each signals in the liquid crystal display panel after offset by the logic board according to an embodiment of the present disclosure.

In the embodiment, the logic board 37 controls the data signals provided by the data driving circuit 35 for the plurality of data lines to delay in sequence by shifting drive signals (TP) provided by the data drive chips in the data driving circuit 35. Referring to FIG. 4, FIG. 4 is a schematic signal timing diagram of each signals in the liquid crystal display panel after offset by the logic board according to an embodiment of the present disclosure.

Wherein Gp1 is a gate signal received by the pixel unit 311, Gp2 is a gate signal received by the pixel unit 312, TP1 is a drive signal provided by the data drive chip 351, TP2 is a drive signal provided by the data drive chip 352, Data1 is a data signal provided by the data driving circuit 35 for the pixel unit 311 through the data line 341, and Data2 is a data signal provided by the data driving circuit 35 for the pixel unit 312 through the data line 342.

According to FIG. 4, a time of the pixel unit 312 to be turned on is delayed a time t than a time of the pixel unit 311 to be turned on, a drive signal provided by the data drive chip 352 is delayed a time t than a drive signal provided by the data drive chip 351, and a data signal provided by the data driving circuit 35 for the pixel unit 312 through the data line 342 is delayed a time t than a data signal provided by the data driving circuit 35 for the pixel unit 311 through the data line 341. Therefore, a time to be turned on matching a time to be charged for the pixel unit 311 and the pixel unit 312.

From the above description, in the embodiment, delaying the data signals provided by the data driving circuit for the pixel units through the data lines by shifting the drive signals provided by the data drive chips enables a time to be turned on matching a time to be charged for the plurality of pixel units in the liquid crystal display panel, and makes the data signals have sufficient charging time, thereby solving non-uniform brightness of panels caused by insufficient charging of the data signals by the delayed gate signals and improving display quality of panels.

Figure 5:
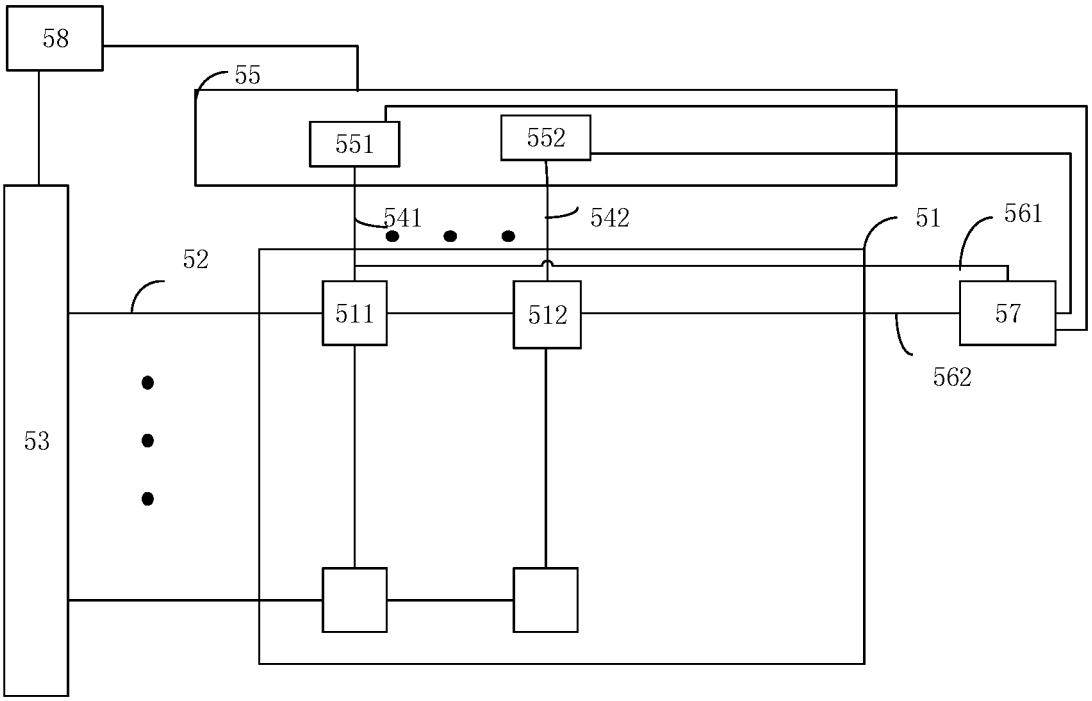
FIG. 5 is a schematic structural diagram of a liquid crystal display panel according to the fourth embodiment of the present disclosure.

Referring to FIG. 5, FIG. 5 is a schematic structural diagram of a liquid crystal display panel according to the fourth embodiment of the present disclosure. The liquid crystal display panel 50 comprises a pixel unit module 51 which comprises a plurality of pixel units, such as a pixel unit 511 and a pixel unit 512; scanning lines 52, a gate driving circuit 53, a data line 541, a data line 542, a data driving circuit 55, a monitor line 561, a monitor line 562, a logic board 57, and a timing controller 58. The data driving circuit 55 comprises a data drive chip 551 and a data drive chip 552, the data drive chip 551 is connected to the data line 541, and the data drive chip 552 is connected to the data line 542.

The structures and connection relationship of the pixel unit 511, the pixel unit 512, the scanning lines 52, the gate driving circuit 53, the data line 541, the data line 542, the data driving circuit 55, the monitor line 561, the monitor line 562, and the logic board 57 are consistent with those of the pixel unit 211, the pixel unit 212, the scanning lines 22, the gate driving circuit 23, the data line 241, the data line 242, the data driving circuit 25, the monitor line 261, the monitor line 262, and the logic board 27 in the liquid crystal display panel according to the second embodiment of the present disclosure, and which will not be iterated herein for the sake of conciseness.

The timing controller 58 is connected to the gate driving circuit 53 and the data driving circuit 55, and is used to control operations of the gate driving circuit 53 and the data driving circuit 55. The timing controller 58 provides clock signals for the gate driving circuit 53 and the data driving circuit 55, making the gate driving circuit 53 and the data driving circuit 55 operate in accordance of the clock signals.

From the above description, the embodiment of the present disclosure makes the gate driving circuit and the data driving circuit operate more accurately by the timing controller.

Figure 6:
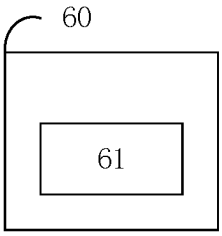
FIG. 6 is a schematic structural diagram of a liquid crystal display device according to an embodiment of the present disclosure.

Referring to FIG. 6, FIG. 6 is a schematic structural diagram of a liquid crystal display device according to an embodiment of the present disclosure. The liquid crystal display device 60 comprises a liquid crystal display panel 61. The liquid crystal display panel 61 is any of the liquid crystal display panels showed in FIG. 1 to FIG. 3, and FIG. 5.

From the above description, the embodiment of the present disclosure can effectively improve display quality and user experiences.

The difference from current techniques is that: the present disclosure provides a liquid crystal display panel, wherein the data signals provided by the data driving circuit for the plurality of data lines are sequentially delayed along a direction away from the gate driving circuit that enables a time to be turned on matching a time to be charged for the plurality of pixel units in the liquid crystal display panel, and makes the data signals have sufficient charging time, thereby solving nonuniform brightness of panels caused by insufficient charging of the data signals by the delayed gate signals and improving display quality of panels.

The present disclosure has been described with a preferred embodiment thereof. The preferred embodiment is not intended to limit the present disclosure, and it is understood that many changes and modifications to the described embodiment can be carried out without departing from the scope and the spirit of the disclosure.

What is claimed is:

1. A liquid crystal display panel, comprising:

a pixel unit module comprising a plurality of pixel units, the plurality of pixel units arranged in a matrix;

a plurality of scanning lines, each of the scanning lines connected to at least two of the pixel units on a same row;

a gate driving circuit connected to the plurality of scanning lines and providing gate signals for the scanning lines to control the pixel units, which the scanning lines are connected to, to be turned on;

a plurality of data lines, the plurality of data lines are respectively connected to at least one pixel unit on different columns;

a data driving circuit, which is connected to the plurality of data lines and provides data signals for the data lines to charge the turn-on pixel units which the data lines are connected to; wherein the data signals provided by the data driving circuit for the plurality of data lines are sequentially delayed along a direction away from the gate driving circuit that enables a time to be turned on matching a time to be charged for the plurality of pixel units in the liquid crystal display panel;

a plurality of monitor lines, each of the monitor lines is respectively connected to a different pixel unit on a same row and monitors the time to be turned on for the pixel unit which each of the monitor lines is connected to;

a logic board connected to the plurality of monitor lines and calculating a time difference of at least two of the pixel units, which the same scanning line is connected to, to be turned on by monitoring the times to be turned on for each of the pixel units through the plurality of monitor lines, wherein the logic board is connected to the data driving circuit, and sends the time difference to the data driving circuit to enable the data signals provided by the data driving circuit for the plurality of data lines to be sequentially delayed along the direction away from the gate driving circuit according to the time difference;

a timing controller connected to the gate driving circuit and the data driving circuit, and used to control operations of the gate driving circuit and the data driving circuit.

2. A liquid crystal display panel, comprising:

a pixel unit module comprising a plurality of pixel units, the plurality of pixel units arranged in a matrix;

a plurality of scanning lines, each of the scanning lines connected to at least two of the pixel units on a same row;

a gate driving circuit connected to the plurality of scanning lines and providing gate signals for the scanning lines to control the pixel units, which the scanning lines are connected to, to be turned on;

a plurality of data lines, the plurality of data lines are respectively connected to at least one pixel unit on different columns;

a data driving circuit, which is connected to the plurality of data lines and provides data signals for the data lines to charge the turn-on pixel units which the data lines are connected to;

wherein the data signals provided by the data driving circuit for the plurality of data lines are sequentially delayed along a direction away from the gate driving circuit that enables a time to be turned on matching a time to be charged for the plurality of pixel units in the liquid crystal display panel.

3. The liquid crystal display panel according to claim 2, further comprising:

a plurality of monitor lines, each of the monitor lines is respectively connected to a different pixel unit on a same row and monitors the time to be turned on for the pixel unit which each of the monitor lines is connected to;

a logic board connected to the plurality of monitor lines and calculating a time difference of at least two of the pixel units, which the same scanning line is connected to, to be turned on by monitoring the times to be turned on for each of the pixel units through the plurality of monitor lines, wherein the logic board is connected to the data driving circuit, and sends the time difference to the data driving circuit to enable the data signals provided by the data driving circuit for the plurality of data lines to be sequentially delayed along the direction away from the gate driving circuit according to the time difference.

4. The liquid crystal display panel according to claim 3, wherein the time to turn on the pixel units is a time for a gate signal voltage of the pixel units reaching 90% of a standard value.

5. The liquid crystal display panel according to claim 4, wherein the standard value is a starting pulse voltage value of the gate driving circuit.

6. The liquid crystal display panel according to claim 3, wherein the logic board controls the data signals provided by the data driving circuit for the plurality of data lines to delay in sequence by shifting the drive signals of the data driving circuit.

7. The liquid crystal display panel according to claim 3, wherein the data driving circuit comprises a plurality of data drive chips, and each of the data drive chips is connected to each of the data lines;

wherein the data drive chips are used to provide the drive signals.

8. The liquid crystal display panel according to claim 7, wherein the plurality of the data drive chips are connected to the logic board, and delay the drive signals in sequence in accordance of the time difference calculated by the logic board.

9. The liquid crystal display panel according to claim 2, further comprising:

a timing controller connected to the gate driving circuit and the data driving circuit, and used to control operations of the gate driving circuit and the data driving circuit.

10. A liquid crystal display device, comprising a liquid crystal display panel, wherein the liquid crystal display panel comprises:

a pixel unit module comprising a plurality of pixel units, the plurality of pixel units arranged in a matrix;

a plurality of scanning lines, each of the scanning lines connected to at least two of the pixel units on a same row;

a gate driving circuit connected to the plurality of scanning lines and providing gate signals for the scanning lines to control the pixel units, which the scanning lines are connected to, to be turned on;

a plurality of data lines, the plurality of data lines are respectively connected to at least one pixel unit on different columns;

a data driving circuit, which is connected to the plurality of data lines and provides data signals for the data lines to charge the turn-on pixel units which the data lines are connected to;

wherein the data signals provided by the data driving circuit for the plurality of data lines are sequentially delayed along a direction away from the gate driving circuit that enables a time to be turned on matching a time to be charged for the plurality of pixel units in the liquid crystal display panel.

11. The liquid crystal display device according to claim 10, wherein the display panel further comprises:

a plurality of monitor lines, each of the monitor lines is respectively connected to a different pixel unit on a same row and monitors the time to be turned on for the pixel unit which each of the monitor lines is connected to;

a logic board connected to the plurality of monitor lines and calculating a time difference of at least two of the pixel units, which the same scanning line is connected to, to be turned on by monitoring the times to be turned on for each of the pixel units through the plurality of monitor lines, wherein the logic board is connected to the data driving circuit, and sends the time difference to the data driving circuit to enable the data signals provided by the data driving circuit for the plurality of data lines to be sequentially delayed along the direction away from the gate driving circuit according to the time difference.

12. The liquid crystal display device according to claim 11, wherein the time to turn on the pixel units is a time for a gate signal voltage of the pixel units reaching 90% of a standard value.

13. The liquid crystal display device according to claim 12, wherein the standard value is a starting pulse voltage value of the gate driving circuit.

14. The liquid crystal display device according to claim 11, wherein the logic board controls the data signals provided by the data driving circuit for the plurality of data lines to delay in sequence by shifting the drive signals of the data driving circuit.

15. The liquid crystal display device according to claim 11, wherein the data driving circuit comprises a plurality of data drive chips, and each of the data drive chips is connected to each of the data lines;

wherein the data drive chips are used to provide the drive signals.

16. The liquid crystal display device according to claim 15, wherein the plurality of the data drive chips are connected to the logic board, and delay the drive signals in sequence in accordance of the time difference calculated by the logic board.

17. The liquid crystal display device according to claim 10, wherein the liquid crystal display panel further comprises:

a timing controller connected to the gate driving circuit and the data driving circuit, and used to control operations of the gate driving circuit and the data driving circuit.

* * * * *